United States Patent [19]

Moeckl et al.

[11] Patent Number: 4,875,418

[45] Date of Patent: Oct. 24, 1989

[54] SET OF COMPONENTS FOR CONSTRUCTING FURNITURE PIECES

[75] Inventors: Ernst Moeckl, Stuttgart; Jörg Stumpf, Wernau; Walter Hardt, Paderborn; Hermann Döinghaus, Delbrück, all of Fed. Rep. of Germany

[73] Assignee: Nixdorf Computer AG, Paderborn, Fed. Rep. of Germany

[21] Appl. No.: 258,078

[22] Filed: Oct. 14, 1988

Related U.S. Application Data

[63] Continuation of Ser. No. 23,435, Mar. 9, 1987, abandoned.

[30] Foreign Application Priority Data

Mar. 11, 1986 [DE] Fed. Rep. of Germany ..... 8606663
Oct. 16, 1986 [DE] Fed. Rep. of Germany ..... 3635108

[51] Int. Cl.[4] ..... A47B 35/00
[52] U.S. Cl. ..... 108/50; 108/111
[58] Field of Search ..... 108/50, 111, 153, 157; 312/257 SK, 257 R, 223; 288/188; 403/231, 403, 205

[56] References Cited

U.S. PATENT DOCUMENTS

| | | | |
|---|---|---|---|
| Re. 28,244 | 11/1974 | Evans | 108/111 X |
| 795,957 | 8/1905 | Cartland | 108/157 X |
| 1,793,709 | 2/1931 | Meyers | 108/157 |
| 2,730,421 | 1/1956 | Burst et al. | 312/257 SK |
| 3,521,579 | 7/1970 | Stafford | 108/153 X |
| 4,083,458 | 4/1978 | Young, Jr. | 108/111 X |
| 4,131,376 | 12/1978 | Busse | 403/231 X |
| 4,278,361 | 7/1981 | Steinke | 403/231 X |
| 4,325,649 | 4/1982 | Röck | 403/231 |
| 4,358,213 | 11/1982 | Hawkins et al. | 403/205 X |
| 4,396,241 | 8/1983 | Winn | 312/257 SK |
| 4,497,093 | 2/1985 | Habercorn | 403/231 X |
| 4,549,831 | 10/1985 | Lautenschläger, Jr. | 403/231 |
| 4,566,742 | 1/1986 | Schmied | 312/257 SK |
| 4,576,502 | 3/1986 | Bancroft | 403/231 |
| 4,589,792 | 5/1986 | Niziol | 403/403 X |
| 4,612,863 | 9/1986 | Vonhausen et al. | 108/50 X |
| 4,634,309 | 1/1987 | Dewey | 403/231 X |
| 4,646,211 | 2/1987 | Gallant et al. | 312/223 X |
| 4,653,652 | 3/1987 | Avati | 108/111 X |

*Primary Examiner*—Peter A. Aschenbrenner
*Assistant Examiner*—Jose V. Chen

[57] ABSTRACT

A set of components for making furniture includes at least an elongated support section (102), connectable with at least one surface element (18) and/or at least one further support section, with such components providing a cable channel (104) extending along the support section (102).

13 Claims, 4 Drawing Sheets

SET OF COMPONENTS FOR CONSTRUCTING FURNITURE PIECES

This is a continuation of co-pending U.S. application Ser. No. 023,435, filed on Mar. 9, 1987, now abandoned.

The invention relates to a set of components for constructing furniture pieces. Especially in the case of office furniture there frequently exists the wish to be able to create a multitude of furniture pieces suiting special purposes from a limited number of simple elements. Beyond that, there also frequently exists in the case of office furniture the necessity to lead cables to electrical work devices in such a way as not to interfere with the performance of work or with the visual appearance.

The invention has as it object the provision of a set of components of the aforementioned type making possible the creation of different furniture pieces having guide ways for cables.

This object is solved in accordance with the invention by having the construction set include at least a longitudinal support section which is connectable with at least one surface element and/or at least one further support section and wherein along the support section a cable channel is formed which is open inwardly toward the outer side of the section. It is thereby provided that independently of the concrete form of the furniture pieces cable, instead of being guided along the support sections and in which case the cable must not be misplaced before the assembly of the furniture pieces, can also be inserted into the cable channels after the assembly of the furniture pieces.

For the creation of furniture pieces with surface elements arranged at an angle to one another it is proposed, in accordance with the invention, that at least one support section is formed as a corner connecting element with at least two fastening surfaces, parallel to the longitudinal direction of the section and arranged at an angle to one another, for two surface elements to be connected to one another, that the fastening surfaces have a spacing from the intersection line of the planes which contain the fastening surfaces, and that between these planes and the section surfaces connected to the edges of the fastening surfaces and extending outwardly a hollow space is formed parallel to the longitudinal direction of the section. If there are surface elements such as for example wall portions of furniture pieces fastened to the fastening surfaces there exists between these and the outer surfaces of the section lying between the fastening surfaces a channel running parallel to the section longitudinal direction in which the cable can be inserted. In the case of a furniture piece, for example a table in which a rear wall and a side wall are connected through a corner connecting element of the invention the connecting cables of electrical devices arranged on or above the table surface can be conducted through the cable channels formed between the rear wall, side wall, and section body without which the laying of individual cable channels would be necessary.

The fastening surfaces do not have to be arranged relative to one another at an angle of 90 degrees, but can instead include an angle departing from a right angle so as to suit the combination of several furniture elements with one another, especially at angles of 60 degrees or 120 degrees.

Advantageously the fastening surfaces are formed on flanges extending from the remainder of the section body, on which flanges the surface elements can be fastened in a simple way as for example by means of screws.

According to a further essential feature of the present invention the section body parallel to the longitudinal direction of the section has at least a first channel with a circular shaped inner cross section and at least one second channel with a polygonal inner cross section. The channels serve to receive the shanks of support yokes for surface elements or devices, in which case the shanks have outer cross sections corresponding to the inner cross section of one of the channels. One support yoke with only one shank, which has a circular outer cross section, can serve to pivotally support for example a picture screen device, a telephone apparatus or the like on a writing table. If the shank has a polygonal cross section matching that of the second channel the support yoke is not rotatable with respect to the corner connecting element. The channels can also be appointed to receive foot parts of a furniture piece insofar as the piece does not rest alone on its wall parts.

Especially in the creation of tables it is advantageous if at least one support section is formed from a girder with which for example a surface element serving as a table plate is pivotally connected for movement about an axis parallel to the longitudinal axis of the girder. In this case it is sufficient if the surface element is pivotal about the longitudinal axis of the girder through only a limited angle. This makes it possible for example to adjust the inclination angle of the table plate to suit a given work operation or the body size of a person. Advantageously in this case the girder is formed from the middle section of a C-shaped yoke with shanks directed perpendicularly to the middle section, which shanks are insertable in the hollow profiles formed by the support sections. This support section can for example be formed by the above mentioned corner connecting element.

A support bracket can be arranged on the girder parallel to its longitudinal axis, which bracket is inclined with respect to a plane perpendicular to the shank of the support yoke and has elongated hole type apertures for receiving insertion parts on a surface element. This makes possible independently of the concrete form of the girder a connection, which is simple in construction and simple to assemble, between the surface element and the girder in which there remains a certain amount of movability between the surface element and the girder. The insertion elements can for example consist of an elastic material and have a shaft part as well as a head part with a larger diameter than the width of the elongated hole type aperture in the support bracket. For making the connection between the surface element and the girder it is sufficient in this case to press the insertion elements into the elongated hole type aperture.

According to another advantageous embodiment of the invention the girder has a circular cross section in which case at the surface element which is connected with the girder has fastened to it shackles which at least partially surround the girder. This embodiment is likewise very simple to assemble and allows a large pivot angle of the surface element about the longitudinal axis of the girder. In both embodiments the cable channel on the girder can be formed by a section bracket parallel to the longitudinal axis and open upwardly, which section bracket is fastened to the girder or for example is formed of one piece with the girder. If necessary the support bracket and the section bracket can be made as one piece, for example in the form of a bent piece of sheet metal which is fastened to the girder formed with a simple hollow profile of polygonal or round cross section.

Further features and advantages of the invention will be apparent from the claims and the following description which explain the invention in connection with the accompanying drawings with respect to exemplary embodiments.

The drawings are:

Figure 5:
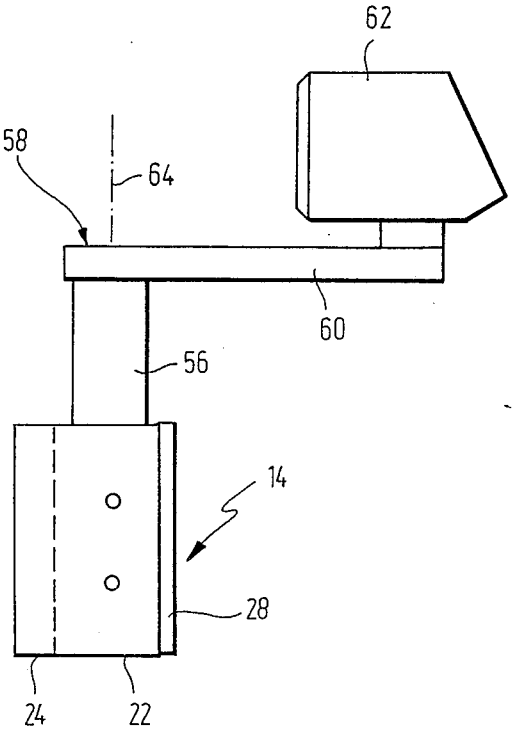

FIG. 5 a schematic side view of a corner connecting element with a support yoke for holding an electrical work device.

Figure 6:
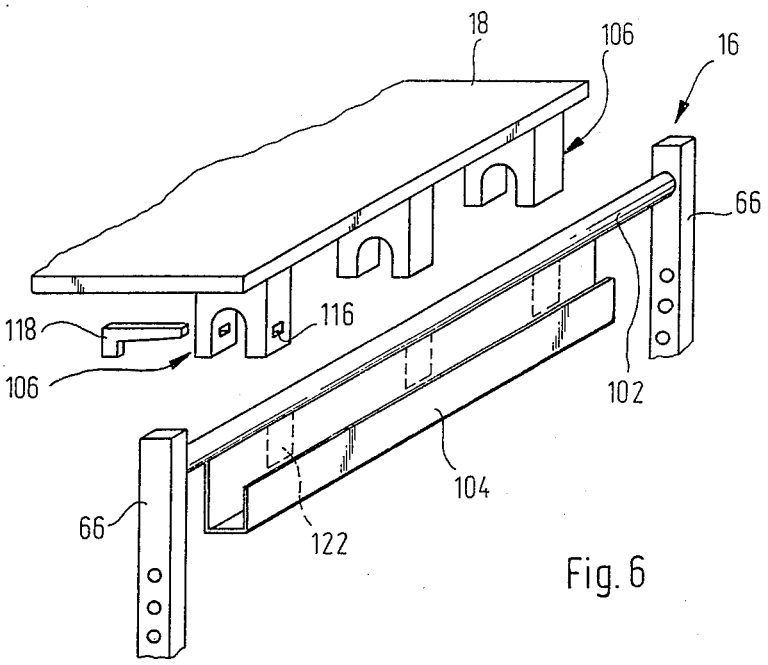
Figure 7:
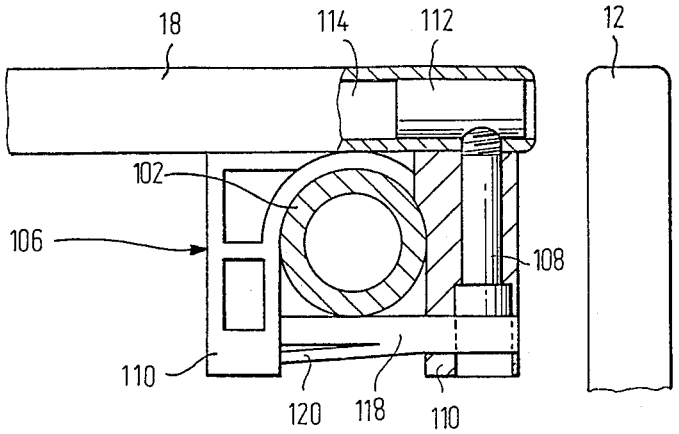

FIG. 6 is a perspective representation of a part of a table plate and a girder according to a further embodiment of the invention, and FIG. 7 is a partial sectional detail view of the connection between the table plate and the girder according to the embodiment of FIG. 6.

Figure 1:
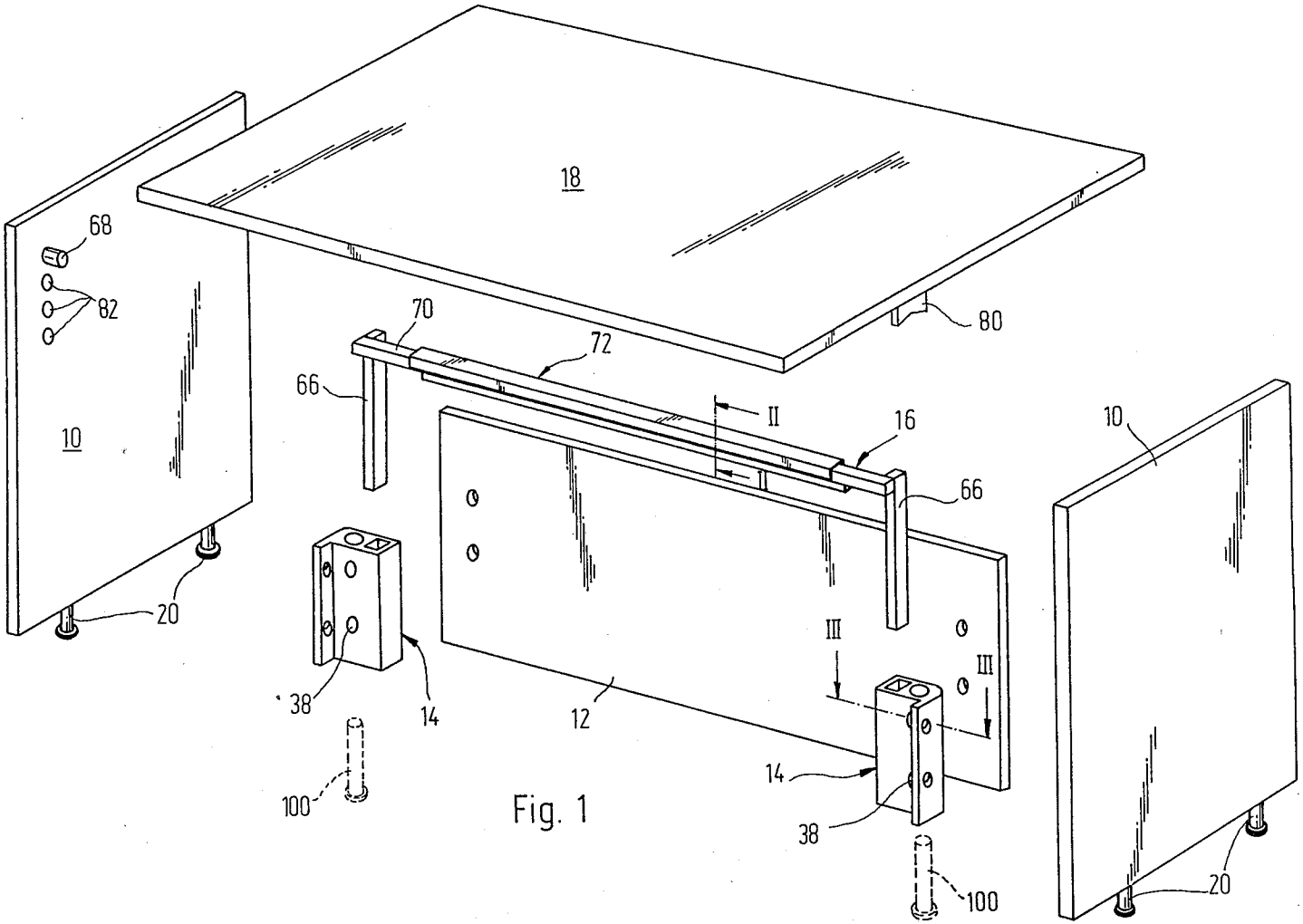
FIG. 1 is a schematic exploded representation of parts of the inventive construction set necessary for the creation of a table.

The construction set shown in FIG. 1 for creating a writing table includes two side walls or parts 10, a rear wall or parts 12, a C-shaped yoke 16 insertable in the corner connecting elements 14, and a table plate or part 18 supportable by the preceding parts. On the lower edge of the side walls 10 are feet 20 on which the assembled table rests, while the corner connecting elements 14 and the rear wall 12 are spaced from the floor.

Figure 3:
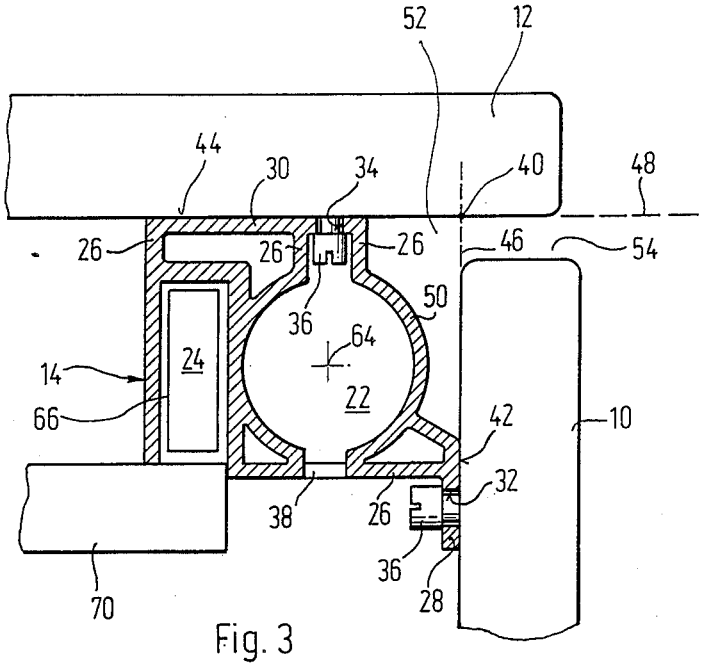
FIG. 3 is a cross section normal to the axis through a connecting element taken along the line III—III in FIG. 1.
Figure 2:
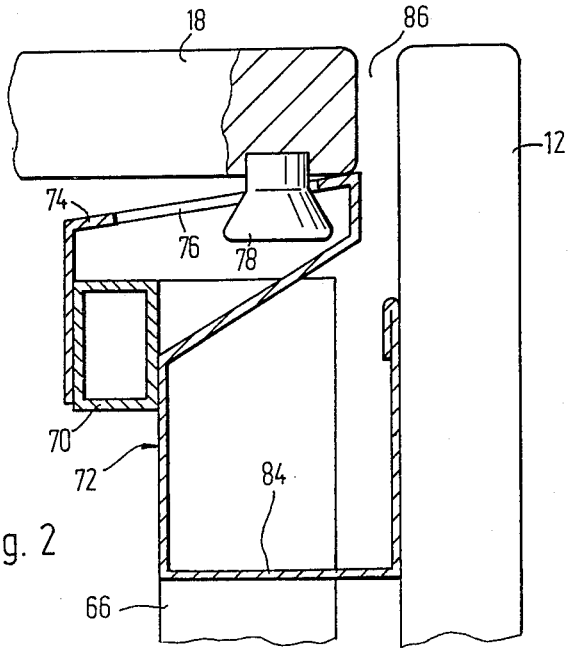
FIG. 2 is an enlarged section along the line II—II in FIG. 1.

In the following the corner connecting element 14 is first described in more detail in reference to FIG. 3. This corner connecting element 14 consists essentially of two parallel channels 22 and 24 surrounded by walls of equal thickness and extending parallel to the element's longitudinal axis, of which channels the first channel 22 has an essentially circular cross section and the second channel 24 has an essentially rectangular cross section. Connected with the channel walls by means of webs 26 are two fastening flanges 28 and 30 with fastening faces 42 and 44 arranged at a right angle to one another and serving for fastening of parts two such as a side wall 10 and the rear wall 12 each having an inner face and an outer face. With regard to this fastening the fastening flanges 28 and 30 have holes 32 or 34 through which screw bolts 36 may pass from the rear to fasten the associated flange to the inner face of the side wall 10 or the rear wall 12. In order to be able to insert the screw bolts 36 from the rear through the holes 34 and in order to be able to turn them, holes 38 are provided in the diametrically opposite wall of the channel 22, which holes 38 permit the insertion of a screw driver or for example a hollow screw key.

The fastening flanges 28 and 30 end at a distance from the intersection edge 40 of planes 46 and 48 containing the fastening surfaces 42 and 44. In this way there exists after the screwing of the side wall 10 and the rear wall 12 to the fastening flanges 28 and 30, between the inner surfaces of the side wall 10 and the rear wall 12 on one hand and between the two webs 26 and the partially cylindrical wall 50 of the first channel 22 lying between the two webs 26, on the other hand, a hollow space 52 which can be used for example as a cable channel for electrical apparatus arranged on or above the table surface 18. The insertion of the connecting cables into the cable channel 52 is made easier in view of the fact that the side wall 10 and the rear wall 12 of the table corner do not engage one another, but instead leave a free slot 54.

The channel 22 serves for example to receive a shank 56, having a circular cross section, of a support yoke 58 whose free support arm 60 carries for example a display device 62, which in this way is held to the table for pivotal movement about the channel axis 64 (FIG. 5).

The second channel 24 of the corner connecting element 14 serves advantageously for receiving a short leg or shank 66 of the C-shaped support yoke 16, whose middle section is another connecting element in the form of a girder for supporting the table plate 18. The height adjustment of the support yoke 16 in the channels 24 of the corner connecting elements 14 can take place in different ways, which in themselves are known, and therefore not shown as for example by means of cotter pins which extend through holes in the corner connecting elements and in the short legs 66 of the support yoke 16 or by means of suitable clamping elements.

On the girder 70 is a support bracket 72 with a Z-shaped cross section for supporting the table plate 18, the bracket 72 being attached to the girder 70 as for example by welding. The bracket 72 has an upper leg 74 sloping downwardly from the rear wall 12 toward the forward side of the table with aperture 75 in which knobs 78 located on the underside of the table plate 18 and made of an elastic material such as rubber can be inset. The table plate 18 has at its side edges notched flanges 80 which are designed to be supported on bolts 68 which can be inserted into holes 82 located at different heights in the side walls 10. In this way the table plate 18 can be adjusted as to its inclination.

The lower part of the support bracket 72 is formed as a trough shaped horizontal cable channel 84 into which connecting cables for electric work devices located along or above the table plate 18 can be inserted through a slot 86 between rear wall 12 and the table plate 18.

Figure 4:
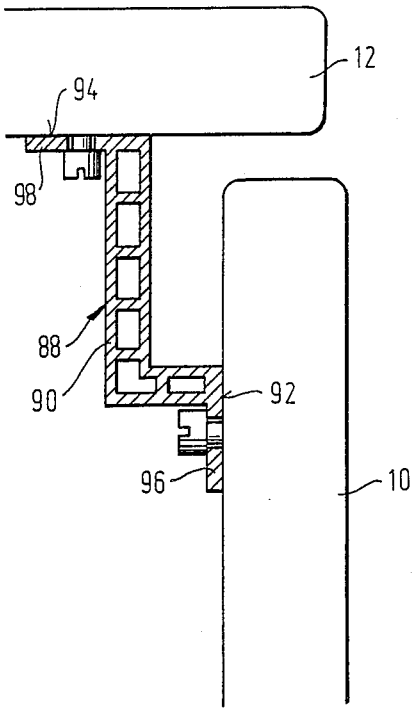
FIG. 4 is a cross section corresponding to FIG. 3, but taken through a modified embodiment of the invention.

FIG. 4 shows a simple form of corner connecting element 88 with a middle section 90 at whose ends flanges 96 and 98 having fastening faces 92 and 94 stand off perpendicular to one another. The middle section 90 of the corner connecting element 88 has solely rectangular channels which serve to receive plug elements such as for example the shanks of support yokes with rectangular cross sections. In FIG. 1 foot elements are indicated at 100 and are insertable in the associated channels 22. The foot elements are shown only in broken line and can be used if the furniture piece is not, as in the illustrated case, to rest on its side walls or on the feet which are connected with the side walls.

In the embodiment illustrated in FIGS. 6 and 7 the C-shaped support yoke 16 again includes shanks 66 which are insertable in the channels 24 of the corner connecting elements. The connecting element or girder 102 forming the middle section of the C-shaped yoke 16 is however made in part of a simple tube having a circular cross section.

Fastened to the tube portion of the girder, as by welding, is a cable channel or cable receiving through 104 made of bent sheet metal. The table plate 18 intended for connection with the girder 102 has on its underside U shaped shackles which are placeable on the girder in overlapping relationship, so that the table plate 18 is pivotal about the longitudinal axis of the girder 102. In FIG. 7 the connection of a shackle 106 with the table plate 18 on one hand and with the girder 102 on the other hand is illustrated in greater detail.

The shackle 106 is fastened to the table plate 18 by means of two screws 108 (of which only one is illustrated) which pass through the shackle leg 110 parallel to its length direction and is received in a threaded hole formed radially in a bolt 112 which bolt is inset in a bore 114 in the table plate 18. The screws 108 can be turned by means of a work tool from the free end of the shackle legs 110.

The shackle legs 110 each have a hole 116 (FIG. 6) through which, after the shackle is set on the girder 102, a retaining pin 118 is inserted and which then inhibits the lifting of the table plate 18 from the girder 102, but the pivotability of the table plate about the longitudinal axis of the girder 102 is not hindered. The retaining pin 118 has a retaining tongue 120 which prevents unintended displacement of the pin 18 from out of the shackle 106.

The sheet metal forming the cable through or channel 104 can in its section which is connected to the girder 102 be provided with apertures 122 which in the swinging of the table plate 18 about the longitudinal axis of the girder permit the entry of the shackles 106. If necessary the cable through or channel 104 can consist of several sections which in the longitudinal direction of the girder 102 are positioned between the shackles 106.

We claim:

1. A construction set for furniture pieces, said construction set comprising:

a connecting element having a longitudinal axis;

a first part and a second part, each of said first and second parts having inner and outer faces;

said connecting element being constructed as to be connected in a predetermined arrangement to said first and to said second parts along each of said first and second part inner faces to hold said first and second parts in assembly with one another and with said connecting element;

said first part when said connecting element is connected to said first and second parts in said predetermined arrangement being spaced from said inner surface of said second part to define a slot therebetween and portions of said inner face of said first and second parts together with a portion of said connecting element defining a channel extending along said longitudinal axis and communicating with said slot;

said channel being accessible from the outer faces of each of said first and second parts to allow a cable to be placed into said channel by moving such cable laterally of itself from a position in front of said outer faces to a position behind said inner faces of said first and second parts;

said connecting element being a corner connecting element with two flanges each containing flat fastening faces extending parallel to said longitudinal axis of said connecting element and arranged at an angle to one another;

said first and second parts are respectively connected adjacent their said inner faces to said fastening faces of said connecting element;

said two fastening faces each terminating short of an intersection line of two planes containing said two fastening faces said connecting element, said first and said second parts when said two parts are connected to said connecting element forming said channel which channel is defined by portions of said inner faces of said first and second parts located between said termination of each fastening face and said intersection line and by said portion of said connecting element.

2. A construction set for furniture pieces, said construction set comprising:

a connecting element having a longitudinal axis;

a first part and a second part, each of said first and second parts having inner and outer faces;

said connecting element being constructed as to be connected in a predetermined arrangement to said first and to said second parts along each of said first and second part inner faces to hold said first and second parts in assembly with one another and with said connecting element;

said first part when said connecting element is connected to said first and second parts in said predetermined arrangement being spaced from said inner surface of said second part to define a slot therebetween and portions of said inner face of said first and second parts together with a portion of said connecting element defining a channel extending along said longitudinal axis and communicating with said slot;

said channel being accessible from the outer faces of each of said first and second parts to allow a cable to be placed into said channel by moving such cable laterally of itself from a position in front of said outer faces to a position behind said inner faces of said first and second parts; and said connecting element has a first channel extending parallel to said longitudinal axis of said connecting element with a circular shaped cross section and has a second channel with a polygonal cross section extending parallel to said longitudinal axis of said connecting element.

3. A furniture construction set according to claim 2 further characterized in that said first channel is bordered by a partially cylindrical wall section with which said flanges are connected.

said intervening surface between said edges of said support member being defined in part by said partially cylindrical wall section and in part by said flanges.

4. A furniture construction set according to claim 2 further characterized in that said second channel has a rectangular cross section.

5. A furniture construction set according to claim 2 further characterized in that it includes at least one support yoke with at least one shank whose outer cross section corresponds to the inner cross section of one of said first and second channels.

6. A construction set for furniture pieces, said construction set comprising:

a connecting element having a longitudinal axis;

a first part and a second part, each of said first and second parts having inner and outer faces;

said connecting element being constructed as to be connected in a predetermined arrangement to said first and to said second parts along each of said first and second part inner faces to hold said first and second parts in assembly with one another and with said connecting element;

said first part when said connecting element is connected to said first and second parts in said predetermined arrangement being spaced from said inner surface of said second part to define a slot therebetween and portions of said inner face of said first and second parts together with a portion of said connecting element defining a channel extending along said longitudinal axis and communicating with said slot;

said channel being accessible from the outer faces of each of said first and second parts to allow a cable to be placed into said channel by moving such cable laterally of itself from a position in front of said outer faces to a position behind said inner faces of said first and second parts;

said connecting element being the first of three such connecting elements included in said construction set, said first one of said connecting element is formed as an elongated girder having a longitudinal axis, and said first and second parts being connected with said first connecting element such that said first part being is a table plate which is connected to said girder for movement about an axis parallel to said longitudinal axis of said girder and said second part is a rear wall; and said second and third connecting elements are each connected with adjacent portions of said rear wall.

7. A construction set according to claim 6 further characterized by each of said second and third connecting elements has a longitudinal axis and includes a channel extending parallel to its longitudinal axis, and said girder being the middle section of a C-shaped yoke having shanks arranged perpendicular to said middle section, said shanks being insertable in said channels of said second and third connecting elements.

8. Furniture construction set according to claim 7, further characterized by said table plate having inner and outer parallel faces and engaging elements fixed to said inner face, and in that on said girder is arranged a support bracket extending parallel to the longitudinal axis of said girder, which bracket is inclined with respect to a plane perpendicular to said shanks of said yoke and which bracket has elongated hole type apertures for receiving said engaging elements of said table plate.

9. A furniture construction set according to claim 8 further characterized in that said engaging elements are made of an elastic material and each have a shank portion as well as a head portion of larger diameter than the width of said apertures in said bracket.

10. A furniture construction set according to claim 7 further characterized in that said cable channel extending along the longitudinal axis of said girder is formed by a bracket fastened to said girder, which bracket extends parallel to said longitudinal axis of said girder and which bracket opens upwardly.

11. A furniture construction set according to claim 10 further characterized by said table plate having parallel inner and outer faces and engaging elements fixed to said inner face, and in that said cable channel formed by said bracket includes a support bracket portion, which support bracket portion is inclined with respect to the plane perpendicular to said shanks of said yoke and which support bracket portion has elongated hole type apertures for receiving said engaging elements of said table plate.

12. A furniture construction set according to claim 10 further characterized in that said bracket is made of one piece with said girder.

13. A furniture construction set according to claim 6 further characterized in that said girder is a simple tube having circular cross section, said table plate having parallel inner and outer faces are parallel with one another, and shackles fastened to said inner face of said table plate and adapted to at least partly surround said tube to connect said table plate to said tube.

* * * * *